United States Patent [19]

Falgout, Sr.

[11] Patent Number: 4,811,635

[45] Date of Patent: Mar. 14, 1989

[54] POWER TONG IMPROVEMENT

[76] Inventor: Thomas E. Falgout, Sr., Rte. 2, Box 11B, Youngsville, La. 70592

[21] Appl. No.: 100,528

[22] Filed: Sep. 24, 1987

[51] Int. Cl.[4] ..... B25B 13/50

[52] U.S. Cl. ..... 81/57.33; 81/57.34; 81/57.35; 81/57.19

[58] Field of Search ..... 81/57.33, 57.34, 57.35, 81/57.19, 57.39, 57.16, 57.18, 57.20, 57.2, 57.21, 57.11, 57.14, 57.15, 57.3

[56] References Cited

U.S. PATENT DOCUMENTS

| | | | |
|---|---|---|---|
| 3,021,739 | 2/1962 | Grundmann | 81/57.35 |
| 4,631,987 | 12/1986 | Buck | 81/57.14 |
| 4,649,777 | 3/1987 | Buck | 81/57.19 |

*Primary Examiner*—James G. Smith
*Assistant Examiner*—Lawrence Cruz
*Attorney, Agent, or Firm*—John D. Jeter

[57] ABSTRACT

An improved powered pipe tong has a frame with a generally central opening and a drive ring with pipe gripping dies arranged for rotation in the opening, about an axis. A fluid powered motor and associated gearing powers the drive ring in either direction about the axis. The dies are closed on pipe to be rotated by energy supplied by a fluid powered ram mounted in the frame and actuated to extend into the drive ring to force pipe gripping dies into gripping contact with pipe. Once the dies are forced into gripping contact with the pipe they are locked in position and the fluid powered ram is withdrawn into the frame to allow the drive ring to rotate with gripped pipe. The lock that holds the dies in closed gripping position while the drive ring rotates can be released in any position of rotating parts. The drive ring is then rotated into position for the ram to again apply force to drive ring mounted parts. If the tong has a side opening, or gap, the ram is in position to apply force when the ring and frame gaps are aligned.

3 Claims, 3 Drawing Sheets

POWER TONG IMPROVEMENT

This invention pertains to power tongs used in well drilling, completion and servicing operations to make up and break out threaded connections in pipe strings.

BACKGROUND

Powered pipe tongs are well established in the art and, for well drilling use, they have evolved with many common characteristics. Back-up tongs do not rotate and their construction can take forms not dictated by rotating machinery. Tongs that rotate pipe carry the pipe gripping dies on the rotating machinery and the die loading elements rotate with pipe. It is common to load the dies with cams on a main drive ring. To allow the dies to be loaded by the cams, the cams are commonly mounted on a die carrier which is held stationary by a brake on the tong frame until the main drive ring has rotated enough to drive the dies toward the pipe with enough force to rotate the pipe. Most power tongs that rotate have radial openings to allow the tongs to be removed from the pipe. The radial openings may be called throats or gaps. The gaps are in the frame, main drive ring and die carrier. In such cases, the main drive ring is called a partial ring. The die carrier is called a partial ring.

In conventional power tongs, the cam angle is designed to apply enough radial loads to pipe to grip the pipe and not slip when proportional torque is applied to the pipe. If the pipe requires little torque when turning begins, the dies do not apply much radial gripping force. This light force allows the tong to wobble about as turning proceeds and the dies then "chew" on the pipe surface and cause damage.

If the dies are initially loaded with the maximum force required to complete the rotational excursion of working one connection, the dies do not "chew". The die gripping force does not damage as a consequence of time of gripping and damage is reduced. The cam and brake arrangement does not lend itself to precision die loading force control.

It is therefore an object of this invention to use force producing means on the tong frame to close and load pipe gripping dies, the forcing means then to remain stationary when the rotating machinery turns with pipe.

It is another object of this invention to provide means in the rotating machinery to store energy to carryout the rotating function without relaxing grip on pipe.

It is still a further object of this invention to provide apparatus to grip and rotate pipe that may be released from the pipe in any rotational position of the apparatus.

It is yet another object of this invention to provide pipe rotating machinery and frame mounted force means to actuate pipe gripping dies, that can be fitted to existing tong frames of conventional design.

These and other objects, advantages, and features of this invention will be apparent to those skilled in the art from a consideration of this specification including the attached claims and appended drawings.

SUMMARY OF THE INVENTION

A powered pipe tong is provided with force means to set the dies with force transmitted to the rotating machinery from a fixed ram on the frame. After setting the dies against pipe, the force producing machinery remains stationary on the frame. The rotating, pipe gripping machinery conserves energy in the rotating parts to maintain grip on pipe until the rotational excursion is complete. Pipe can be released in any rotational position of the rotating parts. The rotating machinery is then rotated relative to the frame, if necessary, to align the cooperating force producing elements on the frame with force receiving elements on the rotating machinery.

For gap sided tongs, the preferred embodiment has two pivoting jaws that can be locked in gripping position. A third die is radially movable against pipe to load all dies.

The radially movable third die can be moved by mechanical ram action to load bias means which maintains die forces during rotation. The third die, alternately can be forced against pipe by a hydraulic cylinder receiving pressure from an accumulator. The accumulator is pumped up by caliper mounted rams attached to the frame which act upon fluid displacement plungers in the rotating machinery, which supply pressure to the accumulator.

The principal, frame mounted rotating ring is also the die carrier. No separate die carrier is required and no brake is needed.

DETAILED DESCRIPTION OF DRAWINGS

In the interest of descriptive clarity various details related to fabrication and maintenance convenience, but not bearing upon the points of novelty, such as welded joints and threaded fasteners, have been omitted.

Figure 1:
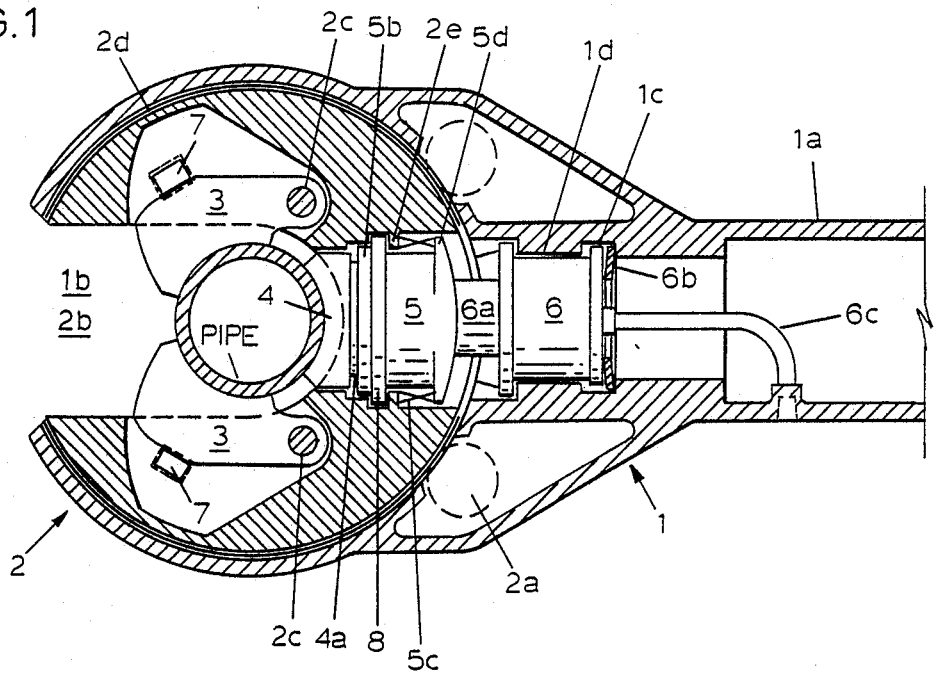
FIG. 1 is a top elevation, partly cut away, of a conventional pipe tong plan form with the preferred embodiment of the improvement of this invention installed, with a work piece pipe in position and gripped for rotation.

In FIG. 1, a top elevation, partly cut away, the principal parts of a power tong are shown. Frame 1 has a generally conventional form in which drive ring 2 is mounted for rotation about an axis that is coincident with the centerline of pipe to be rotated. To move pipe into and out of the central opening, drive ring gap **2*b* and frame gap 1*b*** are aligned.

Pivoting dies 3 are mounted on drive ring 2 by pins **2*c* which are secured to the drive ring. Locks 7 can move vertically in guideways in the drive ring to lock the pivoting dies 3** when in the closed position shown. Details of the locks will be shown later herein.

A third die is radially movable by forces applied by die loading assembly 5. Fluid power assembly 6 is mounted in the frame and ram 6 can move radially to thrust assembly 5 radially toward the axis. Details presented later herein will show a spring situated in assembly 5 arranged to urge die loading ram 4*a* toward the axis, out of assembly 5. When locking flange 5*b* is pushed clear of locking ring 8, ring 8 can rotate a few degrees to prevent flange 5*b* from moving away from the axis. This retains a resilient force to push die 4 against the pipe surface when ram 6*a* is withdrawn to allow the drive ring to rotate. Springs 5*c* are situated in radial grooves to bear on abutments 2*e* and 5*d* to urge assembly 5 radially away from the axis when ring 8 is rotated to unlock flange 5*b*. The locking ring details will be presented later herein. The die 4 is restrained to limited movement relative to assembly 5 and die 4 will move away from the pipe surface when assembly 5 moves away from the axis after unlocking. Fluid power cylinder 6 has plumbing flex line 6*c* leading to a fluid port in the frame. Conventional plumbing and control valve features (not shown), but well established in the art, connect a convenient fluid power source, preferably, to a rig hydraulic system.

Pinions 2*a* are symbolic, representing a gear train, well established in the power tong art, for delivering power from a drive motor along a divided gear path to ring gear 2*d*. The divided gear train can negotiate the conventional gap 2*b* yet deliver continuous power to the drive ring. An additional gap can exist in ring gear 2*d* to allow room for assembly 5. The gearing is not a point of novelty, is in widespread use, and is not shown in detail.

Figure 2:
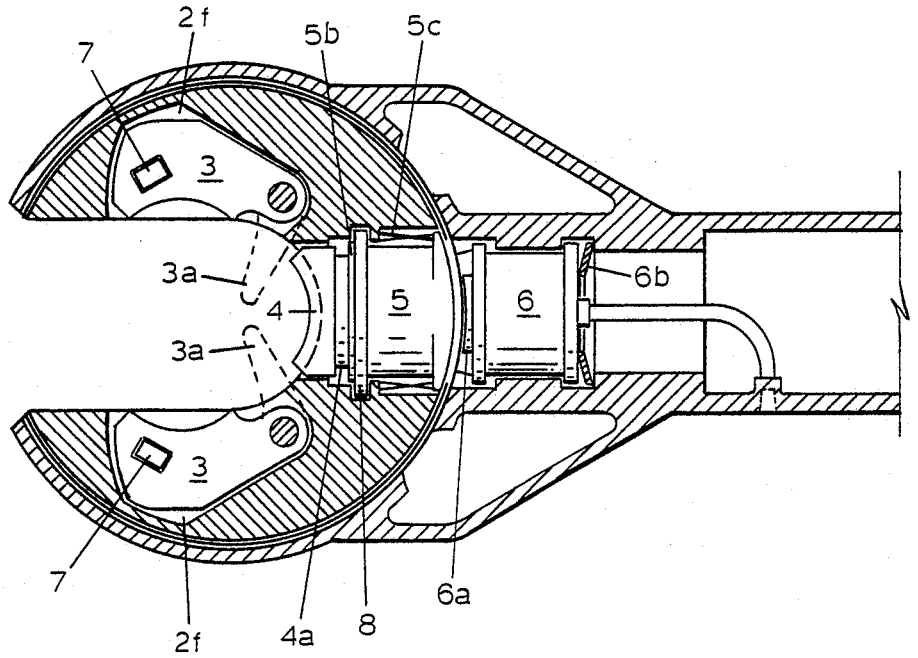
FIG. 2 is identical to FIG. 1 with the pipe gripping means open and the work piece pipe removed.

In FIG. 2, locking ring 8 has been manually rotated to allow flange 5*b* to move radially away from the axis to retract die 4 from the pipe surface. This removed die loading forces from dies 3 and locks 7 were moved to allow the dies 3 to pivot to clear gap 2*b*. The workpiece pipe was removed through the gaps 1*b* and 2*b*.

Levers 3*a* were removed from the figure by the cut away but were attached to dies 3 as shown by the dashed lines. When pipe is again moved to the tong centerline, levers 3*a* are engaged by the pipe surface to rotate the dies 3 to the closed position shown in FIG. 1. At that time, die loading assembly 5 is in the position shown in FIG. 2. Ram 6*a* is in the retracted position which previously allowed the drive ring to rotate. To return to the closed position of FIG. 1, ram 6*a* moves toward the axis under fluid power provided by manual control of valves by way of plumbing previously described. Assembly 5 moves to the FIG. 1 position and is locked. The ram is again withdrawn to allow the drive ring to rotate.

Force cylinder 6 is mounted in the frame for limited movement relative to the frame. Springs 6*b* urge the cylinder toward the axis. When the ram 6*a* applies thrust to assembly 5 it urges the drive ring toward the gap in the frame. It is preferred not to do that because the bearings that support the drive ring may not have been designed for such loads. Details presented later will show that the reaction thrust from cylinder 6 is transferred directly to the drive ring. After ram force is removed, spring 6*b* moves the cylinder toward the drive ring enough for the drive ring to rotate freely through the ring engagement means of the cylinder. Locking ring 8 can be actuated in any rotational position of the drive ring. The drive ring may then be rotated by the tong drive motor to align gaps 1*b* and 2*b*.

Figure 3:
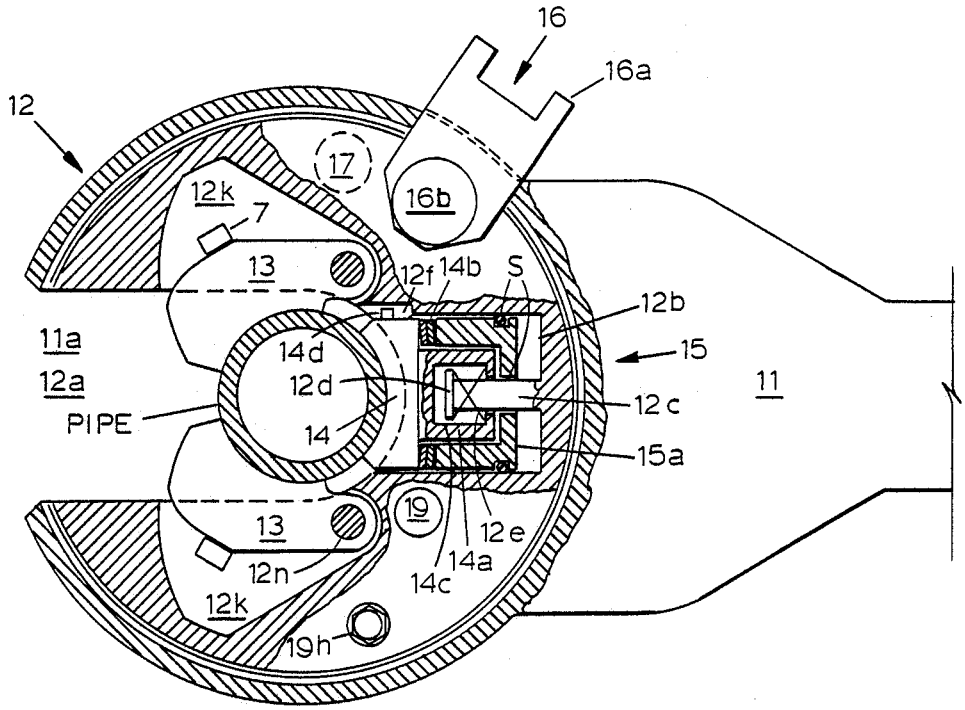
FIG. 3 is a top elevation, partly cut away, of an alternate embodiment of the improvement of this invention that requires little frame modification for retrofit.

FIG. 3 is a top elevation of a conventional powered pipe tong modified by the installation of the drive ring 12 and caliper type fluid powered arrangement 16 of this invention, to close and manipulate the pipe gripping dies.

Tong frame assembly 11 includes means (not shown) to mount drive ring 12, for rotation, in the frame. The frame assembly includes a drive motor and gearing (not shown) to deliver power to rotate the drive ring. The motor and gearing has been previously described herein.

Caliper assembly 16 is bolted or welded to the frame and those fastenings are not shown in detail. Valving and plumbing to power the caliper system will, preferably, be rig hydraulic power delivered through a manual control valve and flex line leading to the caliper fluid port 16*g* of FIG. 4. Plumbing and control options are well established in the art and, hence, are not shown.

Dies are distributed and situated similar to those of FIGS. 1 and 2. Dies 13 pivot and third die 14 moves radially, opposite gap 12*a*.

Cylinder 12*b* is in the drive ring. Piston 15*a* can move radially relative to the tong rotational axis and is urged by fluid pressure toward the axis to force die 14 against the pipe by force transmitted by springs 14*b*. Retainer post 12*c* is secured to the drive ring. Spring 12*e*, acting against the head 12*d* and an interior flange in bore 14*c*, urges die and piston away from the axis. Pin 14*d* slides along groove 12*f* to orient the die.

Piston 15*a* and die 14 can be made one part if an accumulator is used in the hydraulic circuit common to piston 15*a*. The accumulator equivalent, springs 14*b*, maintain die loading forces in the presence of small dimension changes during pipe rotation.

Figure 4:
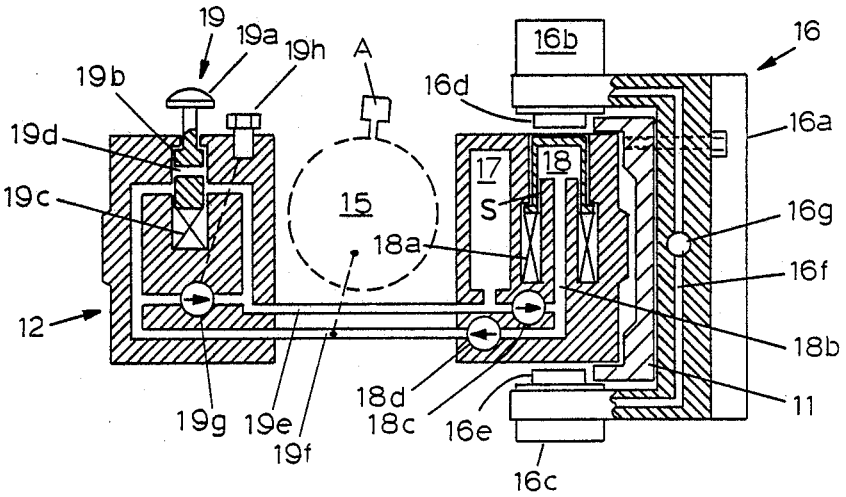
FIG. 4 is a sectional view, partly cut away and partly schematic, showing salient features of the tong of FIG. 3.

In FIG. 4, the caliper fluid power force system is shown cut by an axially directed radial plane passing through the caliper axis of symmetry of FIG. 3 but other features are more schematic to illustrate the fluid circuitry and controls in the drive ring. One side of frame 11 is sectioned to show relationships to caliper frame 16*a*. Drive ring 12 is shown as mounted in the frame on sliding surfaces. Roller bearings are generally used instead but serve the same function.

For retrofit into existing power tong frames, the caliper system is preferred to balance forces applied to ring 12 which may be mounted on bearings not designed for the vertical ram forces.

Caliper frame 16*a* has force cylinder 16*b* atop the tong and force cylinder 16*c* below the tong. When fluid pressure is applied to port 16*g*, both rams 16*d* and 16*e* are thrust toward the drive ring. When gaps 11*a* and 12*a* are aligned, piston 18 is aligned below ram 16*d*. When ram 16*d* depresses piston 18, fluid moves through channel 18*b*, through check valve 18d, to cylinder 15 through the dashed line channel. On the upstroke of ram 16*d* and piston 18, fluid is drawn from reservoir 17, through check valve 18*c* into the piston bore. The piston is urged upward by spring 18*a*. Excess pressure that could cause pipe to crush is vented through adjustable relief valve 19*g* back to the reservoir. Ideally, piston 18 will be of such size that one stroke of the ram will cause piston 15*a* to fully close die 14 but repeated ram strokes are possible by exercising the manual control valve (not shown) that actuates the rams.

Cylinders 16*b* and 16*c* are, ideally, of equal diameter so that vertical forces on the drive ring are equalized.

Figure 5:
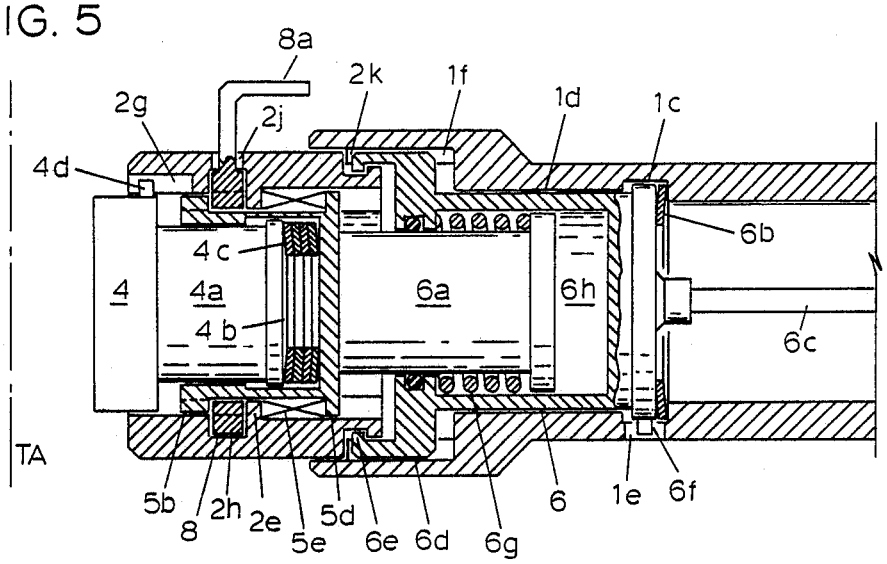
FIG. 5 is a sectional view of the principal die loading elements of FIGS. 1 and 2.

FIG. 5 is a section cut through FIG. 1. The cutting plane contains the tong axis TA and extends to the right along the axis of symmetry of cylinder 6.

Tong frame assembly 1 is more symbolic than specific because emphasis in this figure pertains to the mounting accomodations for cylinder 6. Not yet explained is yoke 6*d*. This yoke is part of the cylinder body and is free to move left and right a small amount in frame clearance opening 1*f*. Fingers 6*e* engage annular groove 2*k* to pull on ring 2 to accept the reaction force applied to ring mounted elements by ram 6*a*. Ram forces are not transmitted through the frame to ring mounting bearings.

Figure 7:
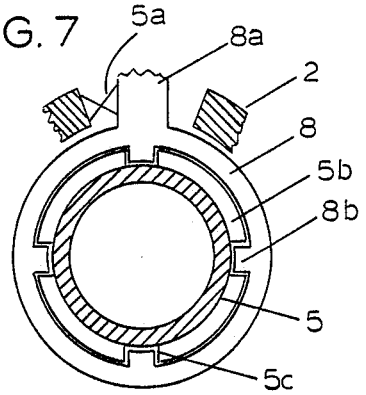
FIG. 7 is a sectional view cut by a plane parallel the tong rotational axis showing locking features for the third die of FIGS. 1, 2 and 3.

Cylinder opening 6*h* receives fluid pressure, from manual controls (not shown), which acts on ram 6*a* to move it to the left, overcoming return spring 6*g*. The housing of die loading assembly 5 is thrust to the left. Locking flange 5*b* moves left os locking ring 8 and the locking ring rotates in capture 2*h*, influenced by spring 5*a*. (see FIG. 7)

Die 4 is thrust against pipe and spring stack 4*c* compresses to provide die loading forces. Pin 4*d* in groove 2*g* keeps die 4 rotationally oriented.

When hydraulic pressure is reduced in cylinder 6*h* by external controls, ram 6*a* is urged right by spring 6*g* to clear ring 2 for subsequent rotation. The force of spring 4*c* is transmitted to ring 2 through flange 5*b*, ring 8 and groove 2*h*. Die 4 will maintain die gripping forces until ring 8 is rotated by lever 8*a* to release flange 5*b*.

Spring 6*b* moves cylinder 6 to the left so that fingers 6*e* are centered in groove 2*k* of ring 2.

When locking ring 8 is rotated manually by lever 8*a*, after rotation of pipe is complete, locking lugs 8*b* (FIG. 7) can move through locking grooves 5*c* to allow die loading assembly 5 to move to the right and die 4 clears the pipe surface.

Figure 6:
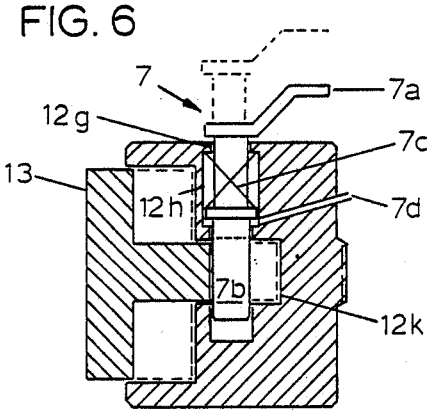
FIG. 6 is a sectional view of the locking features for pivoting die of FIGS. 1, 2 and 3.

FIG. 6 shows the pivoting die locking arrangement for apparatus of tong systems of both FIGS. 1, and 2 and FIG. 3. The captions relate to FIG. 3.

Lock 7 slides up and down in guideways 12*g* in ring 12. Spring 7*c*, in spring cavity 12*h*, urges the lock downward to extend lock bolt 7*b* into an intereference position to keep die 13 leftward against pipe to be turned. To release dies 13 to open the tong, lever 7*a* is lifted, raising lock bolt 7*b*. The die pivots into ring pockets 12*k*. The lever 7*a* can be released and spring 7*c* will push lock bolt 7*b* against the surface of the die. The die can pivot to close and lock bolt 7*b* will be biased into the locking position shown.

There are two dies 13 and two levers 7*a* on opposite sides of the complete tong. It is preferable to connect both levers 7*a* together to unlock pivoting dies simultaneously. The levers 7*a* can be made arcuate to bolt together, clear of gap 12*a*, over the assembly 14. (see FIG. 3)

Figure 8:
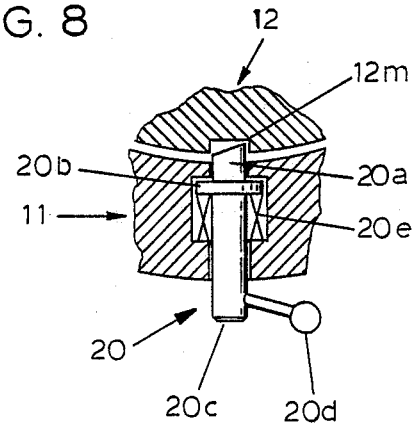
FIG. 8 is a sectional view cut by a horizontal plane showing a position stop common to tongs in general use. No other figures shows this feature.

FIG. 8 shows a conventional position stop 20 normally used to align gaps in both drive ring and tong frame. Plunger 20*c* has skewed end 20*a* that will engage notch 12*m* in drive ring 12 in one direction of rotation of ring 12. It will ratchet over notch 12*m* when ring 12 is rotating in the other direction. Spring 20*e* urges the plunger toward ring 12. Handle 20*d* can be moved to rotate plunger 20*c* about 180 degrees to change the direction in which ring 12 can rotate. In use, the plunger is oriented to allow ring 12 to rotate in the direction of intended pipe rotation. To align the gaps, pipe is normally released and the tong drive motor is reversed until the position stop engages ring 12.

Figure 9:
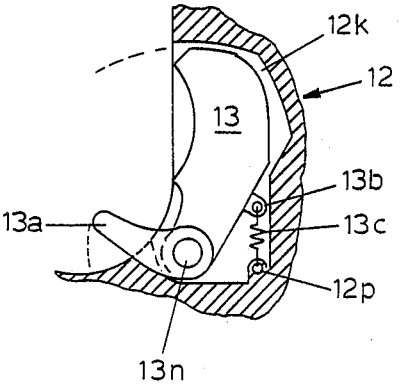
FIG. 9 is a section cut by a horizontal plane showing pivoting die features of tongs of FIGS. 1, 2 and 3.

FIG. 9 applies to all pivoting dies disclosed herein but is captioned with reference to FIG. 3. FIG. 9 represents an area broken out of ring 12 to show spring bias 13*c* attached to dies 13 (there are two dies, one shown) at anchor 13*b* and 12*p* to urge the dies to pivot open. Levers 13*a* are arranged to engage the surface of pipe moving in gap 12*a* toward the tong axis to pivot the dies closed when the pipe reaches the position for gripping. Die 13 and lever 13*a* are both rotationally secured to pivot pin 13*n* which rotates in bearing bores in drive ring 12.

With the description provided for transmitting pipe gripping forces from the frame to the drive ring for one die arrangement, it will be obvious to those skilled in the art that the same arrangement can be used to activate two opposed dies, one on each side of the gap, in the conventional arrangement. Such an arrangement is anticipated by and is within the scope of the claims.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

DEFINITIONS RELATING CLAIMS AND DRAWINGS

Force means refers to cylinder 6 of FIGS. 1, 2 and 5 and cylinder 16*b* of FIGS. 3 and 4.

Force member refers to ram 6*a* of FIGS. 1, 2 and 5 and ram 16*d* of FIG. 4.

Force transfer means refers to die loading assembly 5 of FIGS. 1, 2 and 5 and to piston 18 and cylinder 15 of FIGS. 3 and 4.

Side opening refers to a throat or gap shown as gaps 1*b* and 2*b* of FIG. 1 and gaps 11*a* and 12*a* of FIG. 3.

Lock means refers to locks 7 for pivoting dies and, for the third die, elements 5*b* and 8 of FIGS. 1 and 2 and to valve 19 of FIGS. 3 and 4.

The improvement having been described, I claim:

1. An improved powered pipe tong comprising:

(a) a pipe tong frame having a generally central opening to receive pipe to be rotated;

(b) a drive ring mounted on said frame and arranged for rotation around an axis extending through said opening;

(c) pipe gripping means mounted on said drive ring arranged to releasably grip pipe extending through said opening;

(d) power means mounted on said pipe tong frame and arranged to rotate said drive ring;

the improvement comprising:

(e) force means mounted on said frame and arranged to extend at least one force member toward said drive ring in response to fluid power applied to said force means from an external fluid power source, said force member retractable to clear said drive ring to permit drive ring rotation;

(f) force transfer means mounted on said drive ring, arranged to receive force from said force member and to apply force to said pipe gripping means to grip pipe;

(g) lock means mounted on said drive ring and arranged to releasably lock said pipe gripping means in position when said pipe gripping means is in pipe gripping position.

(h) side openings in said pipe tong frame and in said drive ring through which pipe to be rotated can be moved into and out of the tong; and (i) said pipe gripping means comprising three pipe gripping dies mounted on said drive ring, two of which pivot between first open positions to clear said side opening and second closed positions to grip pipe, about pivot pins mounted on said drive ring, and a third die situated opposite said side opening in said drive ring and arranged to move radially between a first open position to clear pipe and a second closed position to grip pipe.

2. The improved pipe tong of claim 1 wherein said force transfer means is a telescoping mechanical linkage arranged to receive force from said force member and to transfer force to said pipe gripping means through a spring in said force transfer means, arranged to extend said telescoping linkage.

3. The improved pipe tong of claim 1 wherein bias means is situated to convey die loading forces between said force transfer means and said pipe gripping means, said lock means arranged to lock said pipe gripping means by locking said force transfer means, to store pipe gripping force in said bias means.

* * * * *